US007696959B2

(12) United States Patent
Nitta et al.

(10) Patent No.: US 7,696,959 B2
(45) Date of Patent: Apr. 13, 2010

(54) DISPLAY DEVICE AND DRIVING METHOD OF THE SAME

(75) Inventors: Hiroyuki Nitta, Fujisawa (JP); Masahisa Tsukahara, Fujisawa (JP); Toshifumi Ozaki, Koganei (JP)

(73) Assignee: Hitachi Displays, Ltd. (JP)

( * ) Notice: Subject to any disclaimer, the term of this patent is extended or adjusted under 35 U.S.C. 154(b) by 998 days.

(21) Appl. No.: 11/407,043

(22) Filed: Apr. 20, 2006

(65) Prior Publication Data

US 2006/0238456 A1 Oct. 26, 2006

(30) Foreign Application Priority Data

Apr. 22, 2005 (JP) ..... 2005-125103

(51) Int. Cl.
*G09G 3/22* (2006.01)

(52) U.S. Cl. ..... 345/75.2; 345/74.1; 345/75.1; 345/204

(58) Field of Classification Search ..... 345/74.1, 345/75.1, 75.2, 204
See application file for complete search history.

(56) References Cited

U.S. PATENT DOCUMENTS 5,910,792 A * 6/1999 Hansen et al. ..... 345/74.1
2004/0001039 A1 * 1/2004 Shino et al. ..... 345/100

* cited by examiner

*Primary Examiner*—Richard Hjerpe
*Assistant Examiner*—Saifeldin Elnafia
(74) *Attorney, Agent, or Firm*—Antonelli, Terry, Stout & Kraus, LLP.

(57) ABSTRACT

Scan electrode potential detected by a feedback switch is inputted into a negative-phase input terminal of an amplifier, reference selection potential from a reference-selection-potential-signal generation circuit is inputted into a positive-phase input terminal of the amplifier, and the reference-selection-potential-signal generation circuit delays reference potential of a reference voltage source, thereby scan electrode potential without overshooting components can be achieved.

7 Claims, 9 Drawing Sheets

DISPLAY DEVICE AND DRIVING METHOD OF THE SAME

CLAIM OF PRIORITY

The present application claims priority from Japanese application serial no. 2005-125103 filed on Apr. 22, 2005, the content of which is hereby incorporated by reference into this application.

BACKGROUND OF THE INVENTION

The present invention relates to an image display device and a driving method of the device, and particularly relates to the device and the method which are effective for use in an image display device using a multiple electron sources in which electron emitters are disposed in a matrix pattern.

Much attention has been attracted on a self-luminous, matrix-type display in which electron sources are provided at intersections between electrode groups perpendicular to each other, and applied voltage or applied time to respective electron sources are adjusted, thereby the quantity of electrons emitted from the electron sources are controlled, and then the emitted electrons are accelerated by high voltage and thus irradiated to phosphors.

As the electron sources used for this type of display, electron sources using field emission cathodes, thin-film electron sources, carbon nano-tubes, surface-conduction electron emitters and the like are given.

In this type of display panel, line-sequential scan is generally performed. FIG. 7 shows a structural drawing of a display panel in which electron emitters are disposed in a matrix pattern.

In FIG. 7, electron emitters 201 configure respective pixels, and the electron emitters 201 are disposed in the matrix pattern. Respective electron emitters in a vertical direction are connected to data lines 202, and respective electron emitters in a horizontal direction are connected to scan lines 203.

The display panel includes horizontal m dots and vertical n lines, and D1 to Dm are data electrodes for applying data signals on respective data lines, and S1 to Sn are scan line electrodes for applying selection voltage on respective scan lines.

When the line-sequential scan is performed, driving current for all electron emitters connected to selected scan lines flow into a selected scan-line electrode.

FIG. 8 shows a configuration of a drive circuit for driving the display panel using the electron emitters. In FIG. 8, an image signal 210 and a synchronization signal 205 are inputted into a timing controller 206.

The timing controller 206 outputs a control signal 213 for controlling a data-electrode drive circuit 207 that drives data electrodes, a control signal 214 for controlling a scan-electrode drive circuit 208, and image data 212 for generating driving waveforms for driving the data electrodes.

The scan electrode drive circuit 208 selects one scan line among respective scan lines. One of scan selection switches SH1 to SHn is into an on-state, and selection voltage VH is applied to a selected scan line electrode.

Conversely, non-selection operation is performed using non-selection switches SL1 to SLn. A plurality of switches corresponding to scan lines to be in a non-selection state are into the on-state, and consequently non-selection potential LH is supplied to electrodes of the scan lines.

High voltage is supplied from a high-voltage circuit 211 to the display panel 209, and the emitted electrons are accelerated by the high voltage and then irradiated to the phosphors.

FIG. 9 is an operation wave form diagram of the drive circuit shown in FIG. 8. In the line-sequential scan, at the beginning of vertical scan, selection operation is started from a scan line connected to a scan line electrode S1, and then scan is performed sequentially.

The scan selection switch SH1 is into the on-state during a period T1, so that a first scan line is selected. At that time, data voltage Vd11 to Vd1*n* are supplied to respective data lines by the data electrode drive circuit 207.

Next, the scan selection switch SH2 is into the on-state during a period T2, so that data voltage Vd21 to Vd2*n* are supplied to respective data lines. The operation is sequentially performed to display an image corresponding to one field.

U.S. Patent Publication No. 2004/001039 (JP-A-2004-86130) describes an image display device having a correction circuit for correcting voltage variation in a row selection signal due to voltage drop caused by on-resistance of an output stage of a row drive circuit and current flowing into a selected row line according to gray-scale information, and a column drive circuit that generates a modulation signal modulated according to the gray-scale information such that abrupt change in current flowing into the selected row line is restrained.

SUMMARY OF THE INVENTION

As described on the related art, in the self-luminous, matrix-type display in which electron sources are provided at intersections between scan lines and data lines perpendicular to each other, switch elements are used for the scan-electrode drive circuit to select a scan line, and drive current for pixels connected to a selected scan line flows into the relevant switch element, which may amount to several milliamperes. Therefore, a level of voltage drop associated with an on-resistance value of the switch element can not be neglected.

Moreover, the current flowing into the switch element is varied depending on the image content, and accordingly the level of voltage drop may be varied. In this case, electric potential of the scan electrode becomes uneven, and consequently difference in luminance called smear occurs in a horizontal direction.

As a method of reforming the smear, a method where the level of voltage drop is previously calculated based on image data, and the data-electrode drive circuit is used for correction, or a method where a negative feedback amplifier is used to monitor the scan electrode potential, and applied voltage to the switch element is corrected such that the scan electrode potential is equal to predetermined potential has been proposed.

The former method has a difficulty in a point that gray-scale characteristics of an image is sacrificed. In the latter, the gray-scale characteristics is not sacrificed, however as described hereinafter, there has been a difficulty that a waveform containing overshooting components appears on the scan electrodes due to a limited frequency characteristic of the amplifier and due to a point of driving capacitive loads via the switching elements, and consequently predetermined gray-scale can not be obtained.

Hereinafter, a difficulty in a scan-electrode correction circuit to which the negative feedback amplifier is applied in the matrix-type display is described.

FIG. 10 shows a relationship between applied voltage V to two ends of a thin-film electron source and current I flowing into the thin-film electron source when thin-film electron sources are used for the electron sources used for the display panel.

In a region where the applied voltage V is low (V<Vth), current I of the thin-film electron sources is extremely small. When the applied voltage exceeds Vth, current starts to flow into the thin-film electron sources, consequently the current I of the thin-film electron sources increases exponentially.

Vmax shows a maximum value of the applied voltage to the thin-film electron sources. Polarity of the thin-film electron sources in the embodiment is defined as follows: current flows when scan line voltage is higher than data line voltage.

FIG. 11 is a circuit block diagram of the scan-electrode potential correction circuit to which the negative feedback amplifier in the related art is applied. In FIG. 11, only two scan electrodes and switches for driving the electrodes are shown for ease of description.

In FIG. 11, a reference voltage source 13 is a voltage source for determining scan selection voltage, and the voltage is inputted into a positive-phase input terminal of an amplifier 7.

An output terminal of the amplifier 7 is connected with scan selection switches 8 and 15 having on-resistance Ron9 and Ron14, and when a scan selection switch 8 is turned on, scan selection potential is applied to a scan electrode 18. At that time, the thin-film electron sources connected to the scan electrode 18 are into a selection state, leading to light emission.

In the next horizontal scan cycle, the scan selection switch 15 is turned on and thus a scan electrode 19 is into a selection state, leading to light emission.

When the scan electrode 18 is selected, a feedback switch 11 is on, and thus electric potential of the scan electrode 18 is returned into a negative-phase input terminal of the amplifier 7, and then negative feedback operation is performed such that the electric potential of the scan electrode 18 is equal to electric potential of the reference voltage source 13.

FIG. 12 is an operation waveform diagram of FIG. 11. In FIG. 12, Vcont1 is a control signal for the scan selection switch 8 and the feedback switch 11, and the switches are assumed to be on in the high level. When Vcont2 is in the high level, a scan selection switch 15 and a feedback switch 24 are on.

Typically, since data lines for connecting respective electron sources to one another have limited resistance values and limited wiring capacitance, and a data drive circuit has certain output resistance, when the gray-scale voltage is changed, a waveform with certain time constant is formed as shown in Vdata in FIG. 12.

Therefore, when the scan electrodes are driven, a method is taken, wherein a period while any electrode is not selected (hereinafter, called "non-selection period") is set at the beginning of the horizontal scan cycle, and after data voltage comes up to predetermined gray-scale voltage, selection potential is given to a scan electrode. Waveforms at that time are shown in Vs1 and Vs2 in FIG. 12.

In FIG. 11, a non-selection reference voltage source 23 is connected with non-selection switches 12 and 17. During the non-selection period, electric potential of the scan electrodes is fixed to non-selection potential VL.

A switch 16, which is provided to prevent output voltage of the amplifier 7 from being uncertain during each selection period or the non-selection period such as a vertical blanking period, is a negative feedback switch for fixing the output voltage of the amplifier 7 to reference voltage.

Description is made on difficulties with attention on the scan electrode 19 in FIG. 11. The amplifier 7 is assumed to be an ideal amplifier. In transition from the non-selection period where the scan selection switch 15 is off, and the non-selection switch 17 is on to the selection period where the scan selection switch 15 is on, and the non-selection switch 17 is off, a waveform of the output voltage of the amplifier 7 and a waveform of electric potential Vs2 of the scan electrode 19 correspond to a waveform Vs as shown in FIG. 13.

At the beginning of the horizontal scan period, the waveform Vs starts to rise with time constant determined by the on-resistance Ron14 of the scan selection switch 15 and capacitance of a single scan line. The amplifier 7 detects an error component between predetermined reference voltage Vref and scan electrode voltage Vs2, and performs negative feedback operation such that difference between the scan electrode voltage Vs2 and the reference voltage Vref becomes 0 V.

Since the amplifier 7 is the ideal amplifier, the output voltage Vout of the amplifier 7 steeply increases up to supply voltage. After that, from a point when the difference between the scan electrode voltage Vs2 and the reference voltage Vref comes up to 0 V, the output voltage Vout of the amplifier 7 decreases, and the output voltage of the amplifier 7 is into a steady state in a condition that a voltage level corresponding to voltage drop determined by current flowing into the scan line and the on-resistance Ron14 of the scan selection switch 15.

Next, a case that the amplifier 7 is not ideal, and has a limited frequency characteristic is described. FIG. 14 shows an open-loop gain characteristic 25 of the amplifier 7, and a transfer gain characteristic 26 of an RC circuit network configured by the on-resistance 14 of the scan selection switch 15 and panel capacitance.

As a characteristic that the open-loop gain characteristic 25 of the amplifier 7 is decreased at 20 dB/decade, when a transfer function of output voltage to differential input voltage of the amplifier 7 is expressed using complex frequency, it can be expressed by the following equation (1).

(equation 1)

$$\frac{Vout}{Vref - Vs2} = \frac{A}{S\alpha + 1} \tag{1}$$

Here, S is a complex frequency, A is gain of the amplifier, and $\alpha$ is a coefficient.

Similarly, the transfer gain characteristic 26 of the RC circuit network configured by the on-resistance 14 of the scan selection switch 15 and the panel capacitance can be expressed by the following equation (2).

(equation 2)

$$\frac{Vs2}{Vout} = \frac{1}{S\beta + 1} \tag{2}$$

Here, $\beta$ is a coefficient.

In the equation (1), when the differential input voltage Vref-Vs2 is substituted by Vin, and then a transfer function of Vs2 against Vin is obtained, the following equation (3) is obtained.

(equation 3)

$$\frac{Vs2}{Vin} = \frac{A}{S^2\alpha\beta + S(\alpha + \beta) + 1} \quad (3)$$

The transfer function equation (3) contains a second-order lag element. Therefore, a waveform containing overshooting components appears as Vs2 that is the output voltage.

That is, in a negative feedback circuit configured by the amplifier 7, scan selection switch 15, and panel capacitance, waveform delay associated with the second-order lag element occurs, and consequently the waveform containing the overshooting components appears in the scan electrode voltage, which is output of the circuit.

FIG. 15 shows an output voltage waveform in the negative feedback circuit. When the scan electrode wave form containing the overshooting components as shown in FIG. 15 is applied, pedestal level errors or gray-scale errors may occur, resulting in deterioration in image quality.

It is desirable to provide an image display device in which applied voltage to the scan electrodes without overshooting is realized, and consequently an excellent image display can be achieved.

An embodiment of the invention includes a display panel having scan lines and data lines, in which electron emitters are disposed in a matrix pattern, and applied voltage to respective electron emitters is controlled, and emitted electrons are converged and irradiated to phosphors to cause light emission, a scan-electrode drive circuit connected to respective scan lines, a data-electrode drive circuit connected to respective data lines, and a high-voltage circuit that generates high voltage for converging the emitted electrons and irradiating the electrons to the phosphors; wherein the scan-electrode drive circuit includes scan selection switches for selecting a scan line, a scan-electrode potential detection circuit for detecting electric potential of respective scan electrodes, a scan-electrode potential correction circuit that establishes predetermined electric potential for each of the scan electrodes based on scan electrode potential detected by the scan-electrode potential detection circuit, and a reference selection potential signal generation circuit that controls a change rate (delay level) of a scan electrode waveform, and can realize scan electrode voltage without overshooting components in the scan electrode waveform.

According to the image display device according to the embodiment of the invention, an image display device that displays an excellent image without pedestal level errors relief or gray-scale errors can be provided.

DETAILED DESCRIPTION OF THE PREFERRED EMBODIMENTS OF THE INVENTION

Embodiment 1

Figure 1:
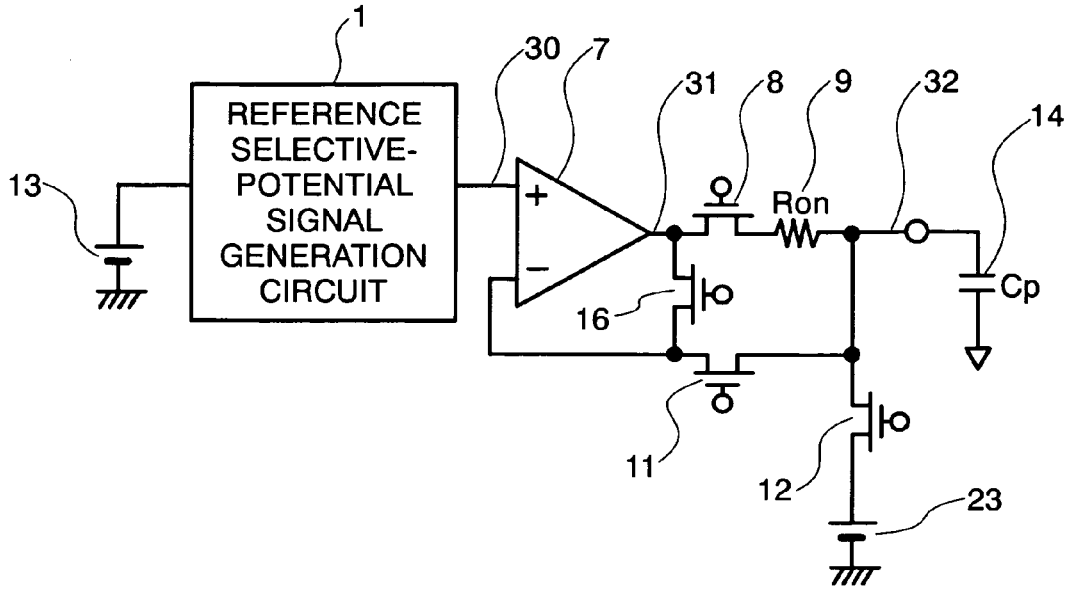
FIG. 1 is a circuit block diagram of embodiment 1 of the invention.

Hereinafter, an image display device according to embodiment 1 of the invention is described. FIG. 1 shows a block diagram of the embodiment, and FIG. 2 shows an operation waveform diagram for illustrating operation in a configuration of FIG. 1.

In FIG. 1, the reference voltage source 13 is a voltage source that determines scan selection potential, which is inputted into a reference-selection-potential-signal generation circuit 1. An output signal of the reference-selection-potential-signal generation circuit 1 gradually rises at the beginning of a selection period of horizontal scan.

Figure 2:
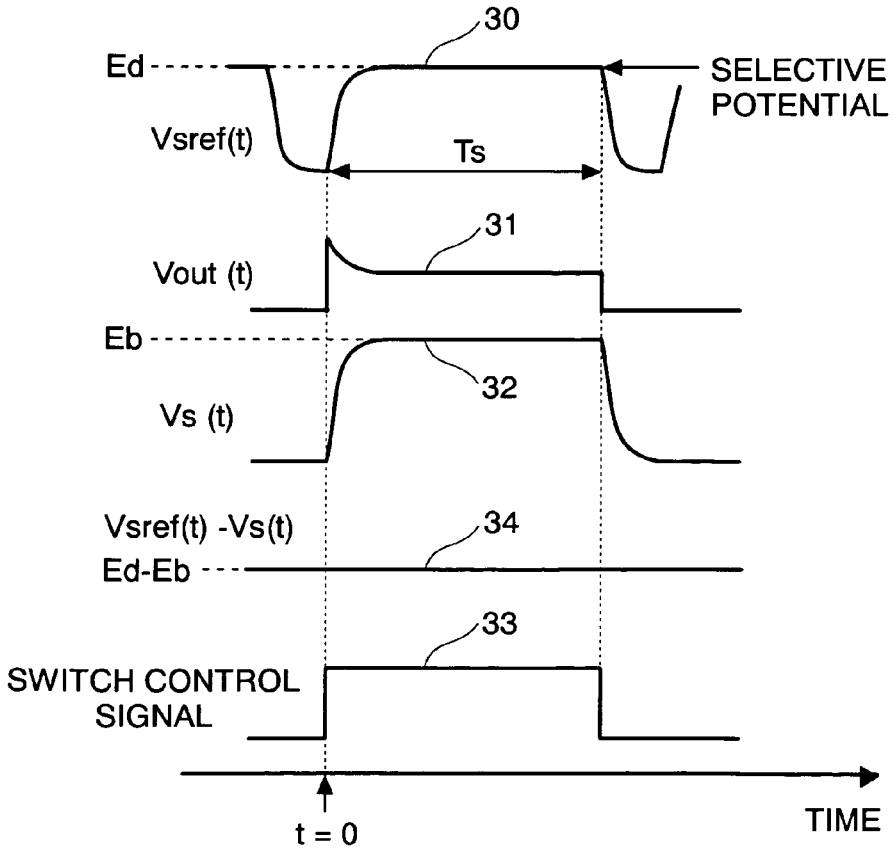
FIG. 2 is an operation waveform diagram for illustrating the embodiment 1.

An output signal 30 of the reference-selection-potential-signal generation circuit 1 is shown as a delayed waveform 30 in FIG. 2. The output signal 30 is applied to a positive-phase input terminal as a reference signal input terminal of the amplifier 7 as a scan-electrode potential correction unit to be into a reference signal in selection of a scan line.

An output terminal of the amplifier 7 is connected with the scan selection switch 8 having on-resistance Ron9, and when the scan selection switch 8 is turned on, scan selection potential is applied to a scan electrode.

A waveform 33 in FIG. 2 is a switch control signal for controlling on-and-off of the scan selection switch 8 as a scan selection unit and the feedback switch 11 as a scan-electrode potential detection unit, and polarity is assumed such that when the switch control signal 33 is in a high level, the scan selection switch 8 and the feedback switch 11 are on.

Figure 8:
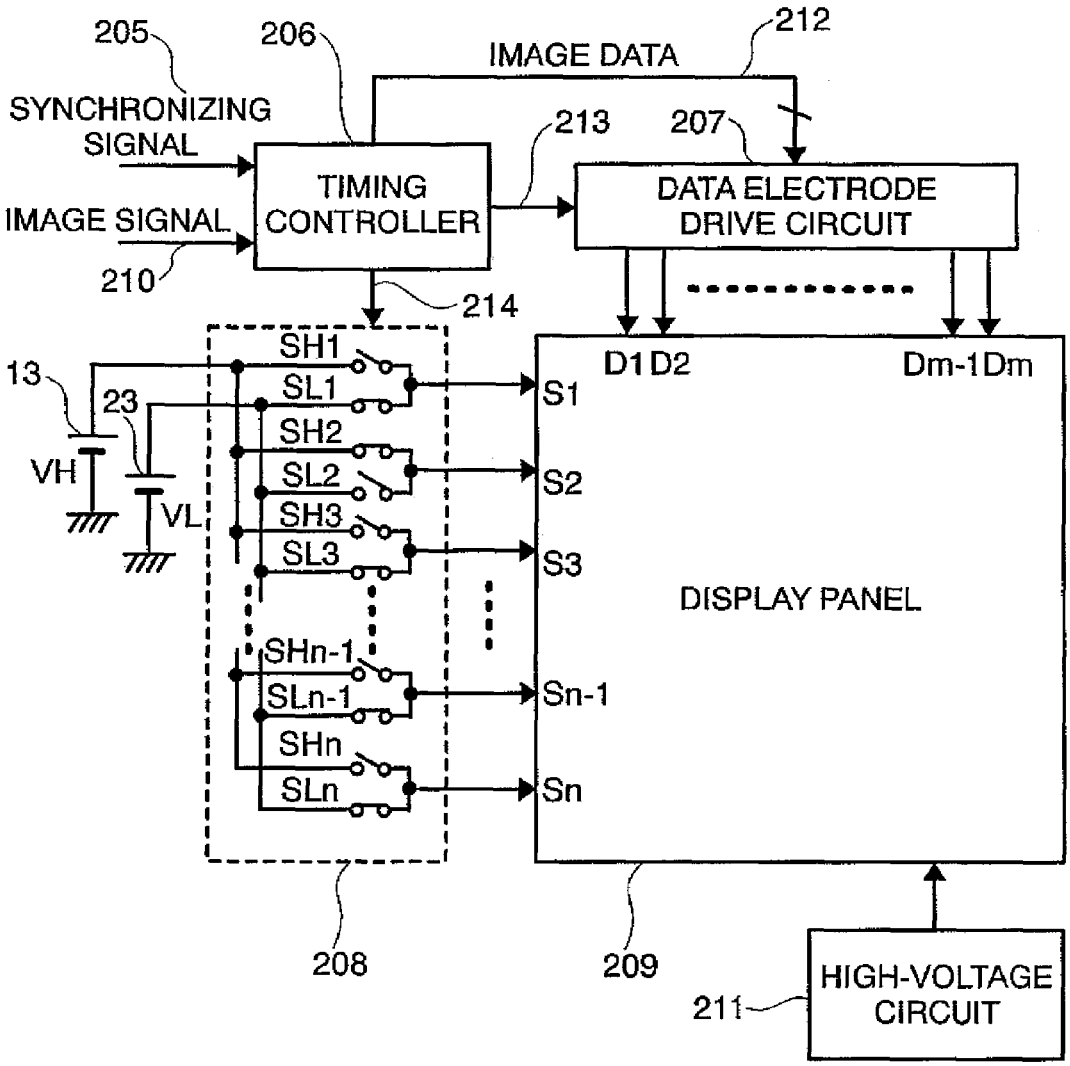
FIG.8 (Prior Art)
FIG. 8 is a block diagram of a drive circuit for driving the display panel of FIG. 7.
Figure 9:
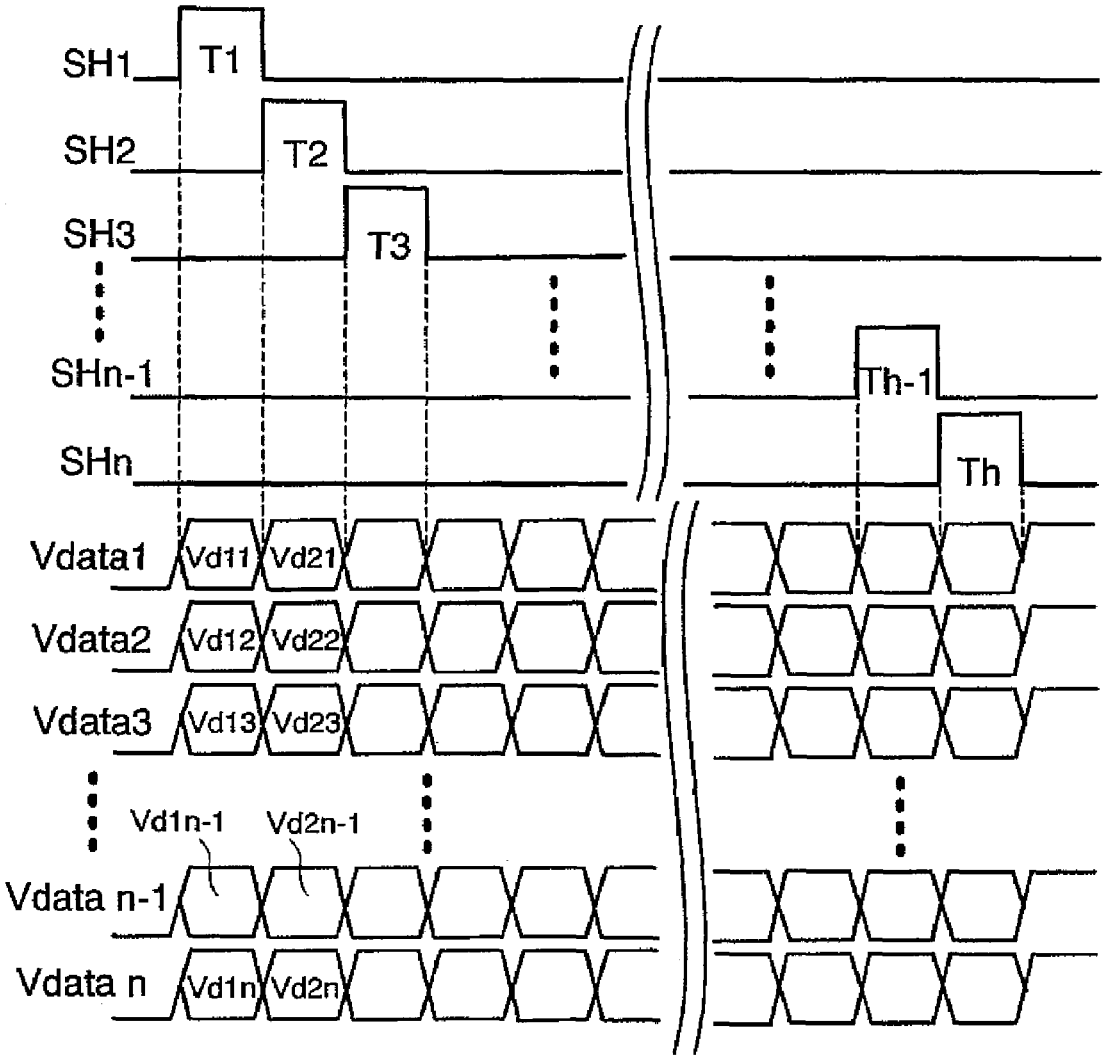
FIG.9 (Prior Art)
FIG. 9 is an operation waveform diagram for illustrating operation of the drive circuit of FIG. 8.
Figure 10:
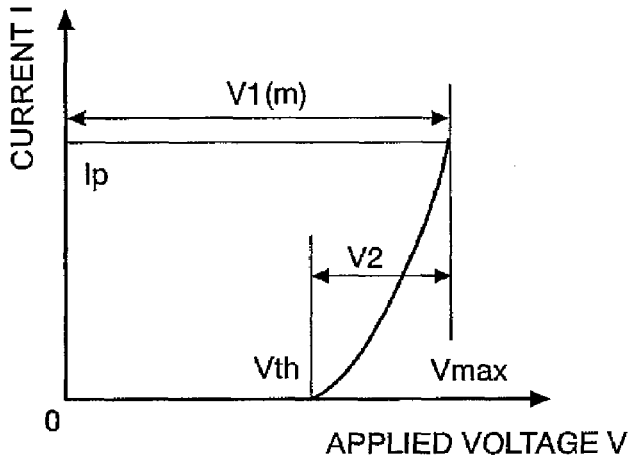
FIG.10 (Prior Art)
FIG. 10 is a voltage-current characteristic diagram of a thin-film electron source.
Figure 11:
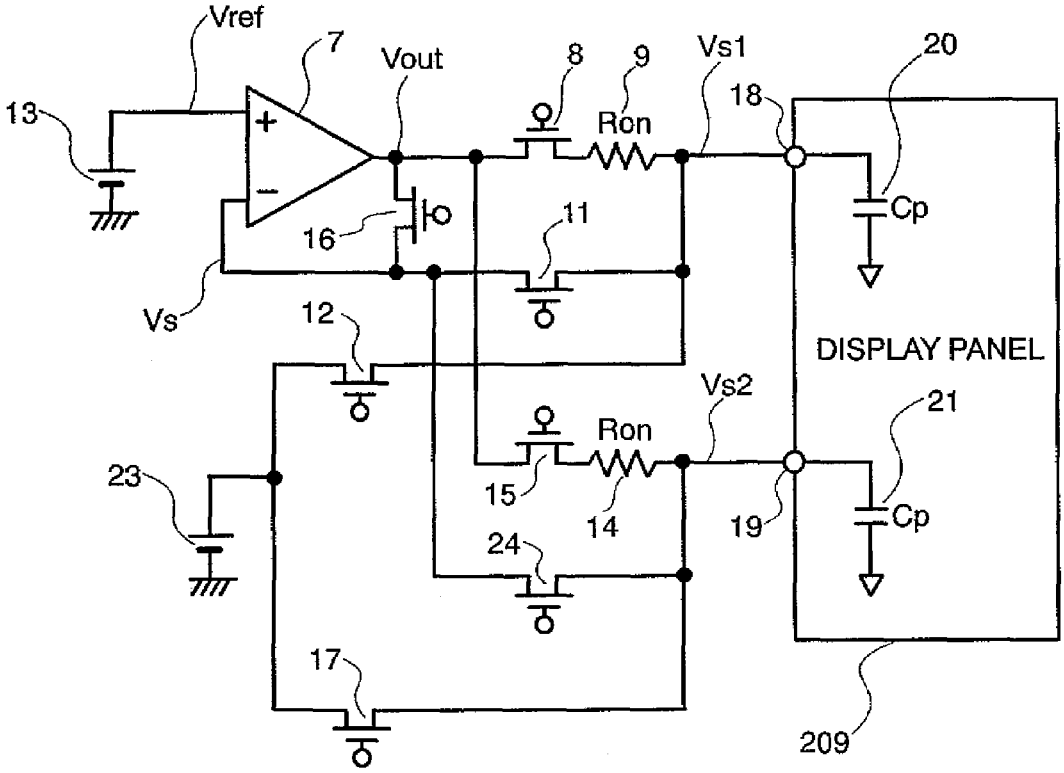
FIG.11 (Prior Art)
FIG. 11 is a circuit block diagram of a scan-electrode correction circuit to which a negative feedback amplifier according to the related art is applied.
Figure 12:
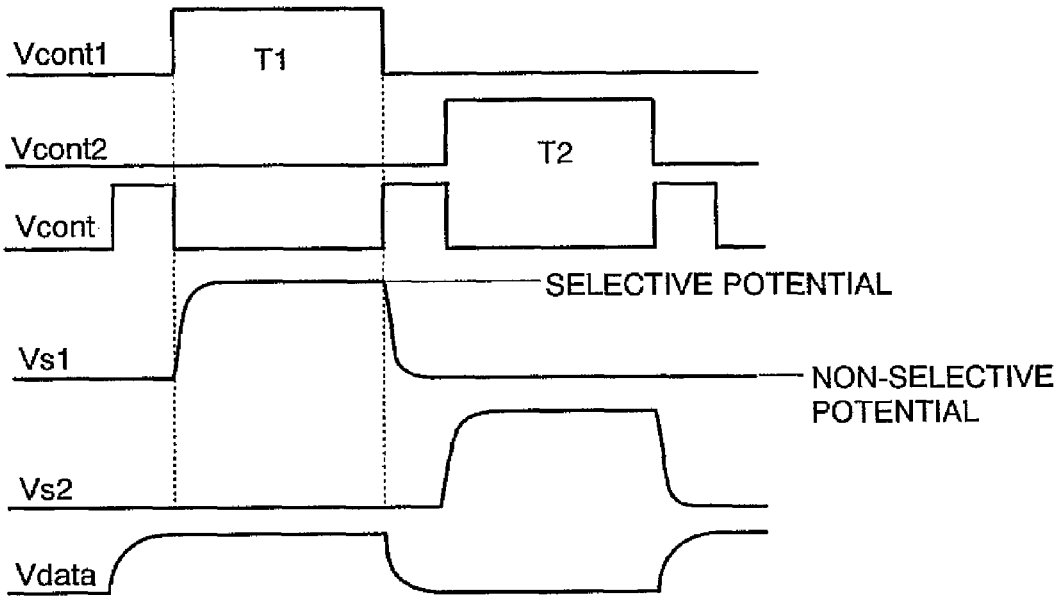
FIG.12 (Prior Art)
FIG. 12 is an operation waveform diagram in the related art.
Figure 13:
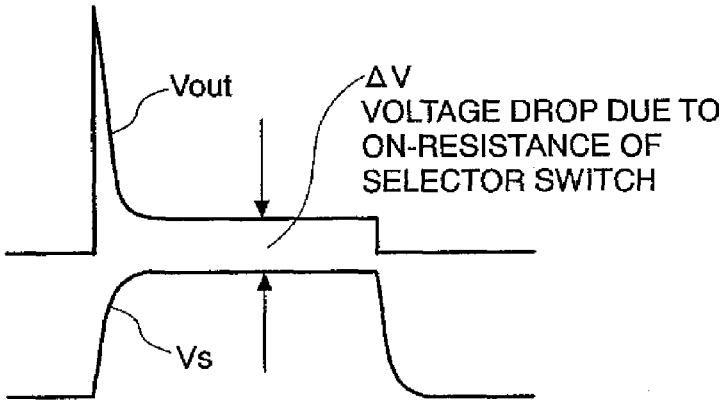
FIG.13 (Prior Art)
FIG. 13 is an operation waveform diagram of the scan-electrode correction circuit to which an ideal amplifier is applied.
Figure 14:
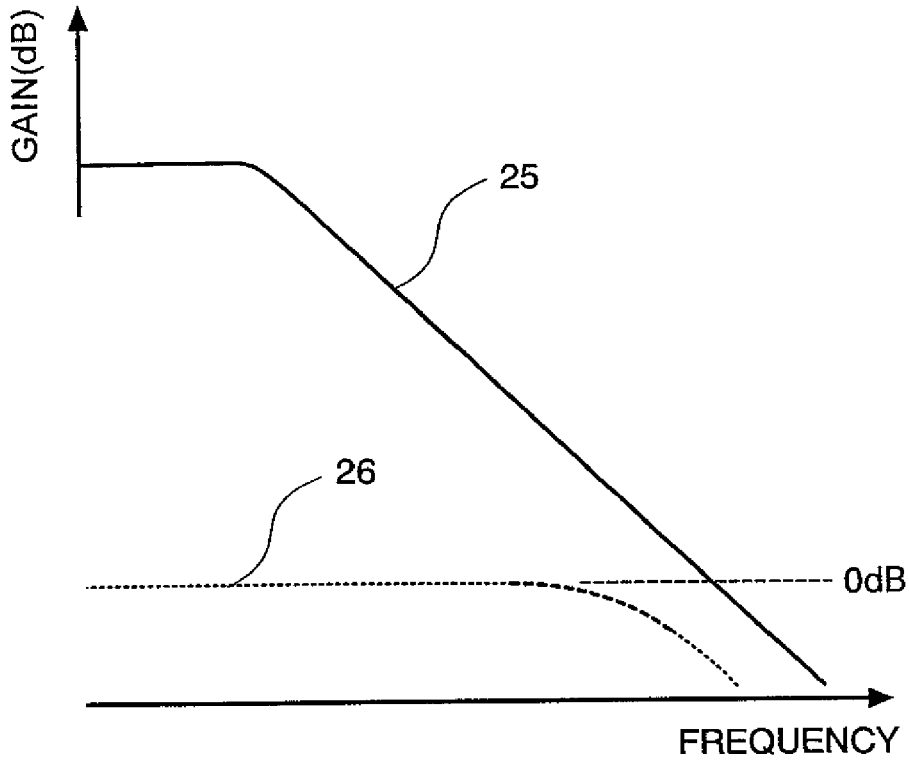
FIG.14 (Prior Art)
FIG. 14 is an open-loop gain characteristic diagram of an amplifier, and a transfer gain characteristic diagram of an RC circuit network configured by on-resistance of a scan selection switch and panel capacitance.
Figure 15:
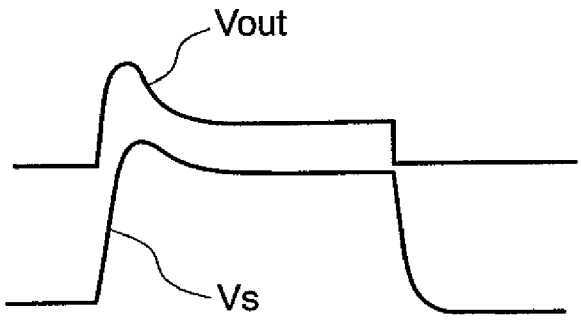
FIG.15 (Prior Art)
FIG. 15 is an operation waveform diagram of the scan-electrode correction circuit to which an amplifier having a limited characteristic is applied.

A scan selection period Ts corresponds to a high level period of the switch control signal 33. Timing at which the switch control signal 33 is changed from a low level to the high level is set in synchronization with the time when data-electrode drive voltage comes up to predetermined potential. The switch control signal 33 is supplied from the timing controller 206 shown in FIG. 8.

At the time t=0 in FIG. 2, the switch control signal 33 is into the high level, and the scan selection switch 8 and the feedback switch 11 transit into an on-state. With the time as starting time, the scan selection period Ts begins, and light emission operation is performed.

The scan electrode potential is returned into the negative-phase input terminal of the amplifier 7 by the feedback switch 11, and then negative feedback operation is performed such that the scan electrode potential is equal to the potential of the reference voltage source 13. The transfer function of the scan electrode voltage against the differential input voltage of the amplifier 7 was mentioned with respect to the equation (3).

In FIG. 1, the transfer function of the scan electrode voltage against the differential input voltage of the amplifier 7 in complex frequency can be expressed by the following equation (4) using the equation (3).

(equation 4)

$$Vs = \frac{A}{S^2\alpha\beta + S(\alpha+\beta)+1}(Vsref - Vs) \tag{4}$$

When Vsref and Vs are converted into time functions using Laplace inverse transformation, the functions are assumed to be Vsref(t) and Vs(t) respectively. Generally in rise time, Vs(t) can be handled using a time function in the natural logarithm, and when Vsref(t) is a DC signal, Vsref(t)−Vs(t) as the differential input voltage can be expressed by the following equation (5).

(equation 5)

$$Vsref(t)-Vs(t)=Ed-Eb(1-\exp(-at)) \tag{5}$$

The function contains higher-order frequency components, which means that response in a circuit network containing the transfer function of the equation (4) includes an output waveform which contains many overshoot components.

In other words, Vsref (t) is obtained such that a transient term in the equation (5) is canceled, thereby the high-order frequency components are decreased, and consequently overshooting components is reformed. That is, Vsref(t) is substituted by the following equation (6), thereby the transient term is canceled.

(equation 6)

$$Vsref(t)=Ed-Eb\exp(-at) \tag{6}$$

A circuit network that can be expressed by the equation (6) is provided as the reference-selection-potential-signal generation circuit 1, thereby the differential input voltage of the amplifier 7 can be expressed as the following equation (7).

(equation 7)

$$Vsref(t)-Vs(t)=Ed-Eb \tag{7}$$

A circuit network of FIG. 1 of the embodiment is a circuit network of which the state is changed with time, and Vsref (t)−Vs(t) as the differential input voltage of the amplifier 7 can be handled as the DC signal, therefore the overshooting waveform, which indicates the high frequency components of the scan-electrode drive waveform, can be reformed.

According to the embodiment, scan electrode voltage without overshooting components can be realized for the driving waveform of the scan electrodes of the matrix-type display using the electron emitters as the electron sources, and excellent image display without pedestal level errors or gray-scale errors can be achieved.

Embodiment 2

Figure 3:
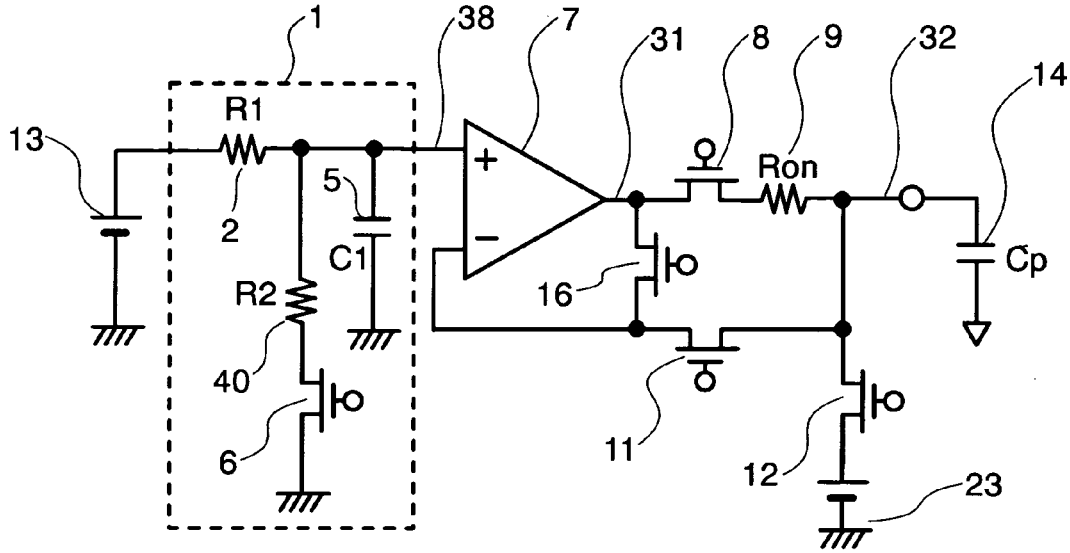
FIG. 3 is a circuit block diagram of embodiment 2 of the invention.

Hereinafter, another embodiment of an image display device according to the invention is described using FIG. 3 and FIG. 4. FIG. 3 is a circuit block diagram of the embodiment, and FIG. 4 is an operation waveform diagram for describing operation in a configuration of FIG. 3.

In FIG. 3, the output terminal of the reference voltage source 13 is connected with the resistor 2 having a resistance value R1, and the capacitor 5 having a capacitance value C1 is connected between one end of the resistor 2 and ground. The resistor 40 having a resistance value R2 is connected to a connection point between the resistor 2 and the capacitor 5, and the switch 6 is connected in series with the resistor 40, which is further connected to ground.

Figure 4:
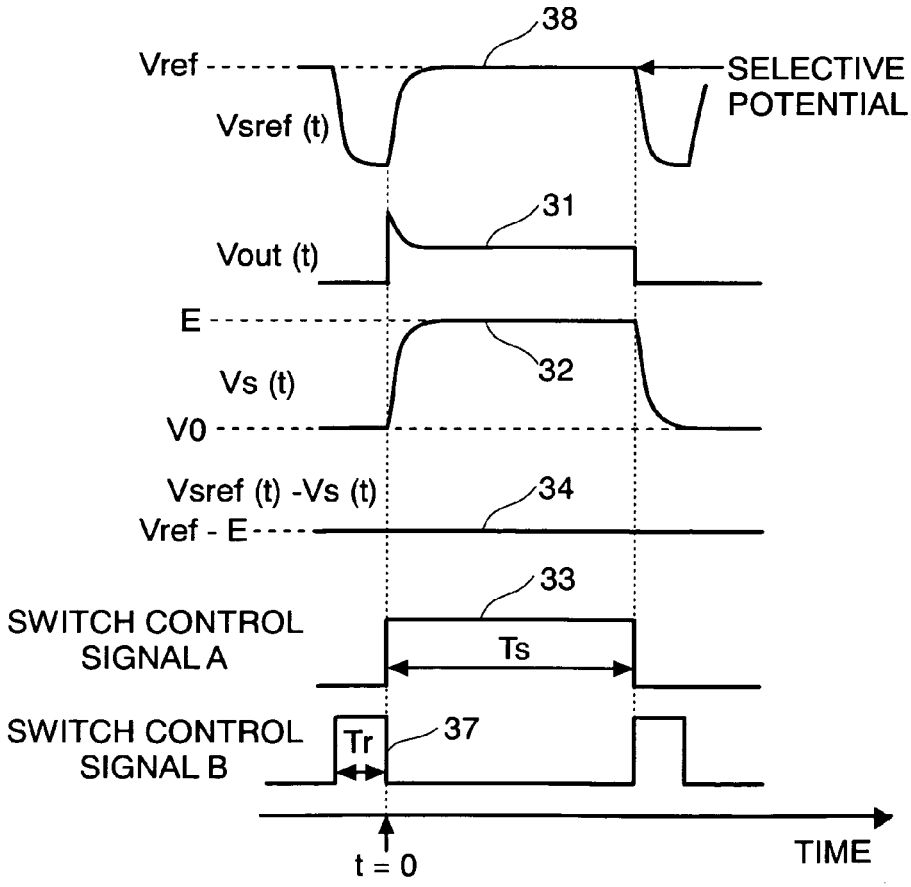
FIG. 4 is an operation waveform diagram for illustrating the embodiment 2.

A waveform 33 in FIG. 4 is a switch control signal A for controlling on-and-off of the scan selection switch 8 and the feedback switch 11, and polarity is assumed such that when the switch control signal A is in the high level, the scan selection switch 8 and the feedback switch 11 are on.

The scan selection period Ts corresponds to a high level period of the switch control signal A. Timing at which the switch control signal A is changed from the low level to the high level is set in synchronization with the time when the data-electrode drive voltage comes up to the predetermined potential. The switch control signal 33 is supplied from the timing controller 206 shown in FIG. 8.

At time t=0 in FIG. 4, the switch control signal A is into the high level, and the scan selection switch 8 and the feedback switch 11 transit into the on-state. With the time as the starting time, the scan selection period Ts begins, and light emission operation is performed.

The scan electrode potential is returned into the negative-phase input terminal of the amplifier 7 by the feedback switch 11, and then negative feedback operation is performed such that the scan electrode potential is equal to the potential of the reference voltage source 13.

On the other hand, a waveform 37 in FIG. 4 is a switch control signal B for controlling on-and-off of switches 6 and 16, and polarity is assumed such that when the switch control signal B is in the high level, the switches 6 and 16 are on.

A non-selection period Tr corresponds to a high level period of the switch control signal B, which is set before and after the scan selection period. The switch control signal B is supplied from the timing controller 206 shown in FIG. 8.

During the non-selection period, the output voltage of the amplifier 7 is returned into the negative-phase input terminal of the amplifier 7. Therefore, the output voltage of the amplifier 7 during the non-selection period corresponds to divided voltage of the voltage Vref of the reference voltage source 13 by the resistor 2 and the resistor 40, and Vsref (0) as initial voltage in the scan selection period is given by the following equation (8).

(equation 8)

$$Vsref(0) = \frac{R2}{R1+R2}Vref \tag{8}$$

In the time t≧0, the switch 6 and the switch 16 are off, and the scan selection switch 8 and the feedback switch 11 transit into the on-state. A reference-signal-selection-voltage signal 38 during the scan selection operation period can be expressed by a time function of the following equation (9) with the equation (8) as the initial voltage.

(equation 9)

$$Vsref(t) = Vref \cdot \left(1 - \exp\left(-\frac{1}{R1 \cdot C1} \cdot t\right)\right) + Vref \cdot \left(\frac{R2}{R1 + R2}\right)\exp\left(-\frac{1}{R1 \cdot C1} \cdot t\right) \quad (9)$$

Here, a time function of the scan electrode potential is substituted by the following equation (10). In the equation (1), E·(1−exp(−bt)) is the zero state response, and V0·exp(−bt) is the zero input response.

(equation 10)

$$Vs(t)=E\cdot(1-\exp(-bt))+V0\cdot\exp(-bt) \quad (10)$$

The differential input signal in the amplifier 7 can be expressed by the following equation (11) using the equation (9) and the equation (10).

(equation 11)

$$Vsref(t) - Vs(t) = Vref \cdot \left(1 - \exp\left(-\frac{1}{R1 \cdot C1} \cdot t\right)\right) + Vref \cdot \left(\frac{R2}{R1 + R2}\right)\exp\left(-\frac{1}{R1 \cdot C1} \cdot t\right) - E \cdot (1 - \exp(-bt)) - V0 \cdot \exp(-bt) \quad (11)$$

The following equation (12) is obtained by transforming the equation (11). The equation (12) means that natural logarithm terms can be eliminated by appropriately selecting the resistance value R1, resistance value R2, and capacitance value C1.

(equation 12)

$$Vsref(t) - Vs(t) = Vref - Vref \cdot \left(\frac{R1}{R1 + R2}\right) \exp\left(-\frac{1}{R1 \cdot C1} \cdot t\right) - E + (E - V0) \exp(-bt) \quad (12)$$

According to the equation (12), a circuit condition is given according to the following equation (13), thereby high frequency components in the output voltage can be eliminated. In other words, the over shooting components in the output voltage can be eliminated.

(equation 13)

$$E - V0 = \frac{Vsref \cdot R1}{R1 + R2} \qquad b = \frac{1}{R1 \cdot C1} \quad (13)$$

Next, as a specific example, in the case that a display panel in the VGA specification (640 dots×RGB×480 lines) is driven, the resistance values R1 and R2 and the capacitance value C1 are obtained. As a typical condition, the scan selection voltage is set to be 10 V, and the non-selection voltage is set to be 5 V.

In the equation (12) and the equation (13), voltage E is the scan selection voltage, and V0 is the non-selection voltage. The coefficient b is the time constant determined by the on-resistance Ron9 of the scan selection switch 8 and the capacitance value Cp of the capacitor 14.

When capacitance of one pixel is assumed to be 20 pF, the capacitance value Cp is 38400 pF. Corresponding to this, since scan-selection-switch current reaches several hundreds milliamperes to several amperes, the on-resistance Ron9 of the scan selection switch 8 is desirably set to have a low on-resistance value of 1Ω or lower.

However, practical on-resistance in the case of configuring a circuit by LSI is set to be several ohms to several tens ohms from a view point of chip size. Here, the on-resistance value of the scan selection switch 8 is assumed to be 10 Ω.

Furthermore, C1 is assumed to be 1000 pF. In the above condition, using the equation (13), since R1 is 384Ω, the scan selection voltage is 10 V, and non-selection voltage is 5 V, R2=384Ω can be introduced.

According to the embodiment, as in the embodiment 1, the scan electrode voltage without overshooting can be realized for the driving waveform of the scan electrodes of the matrix-type display using the electron emitters as the electron sources, and the excellent image display without pedestal level errors or gray-scale errors can be achieved.

Embodiment 3

Figure 5:
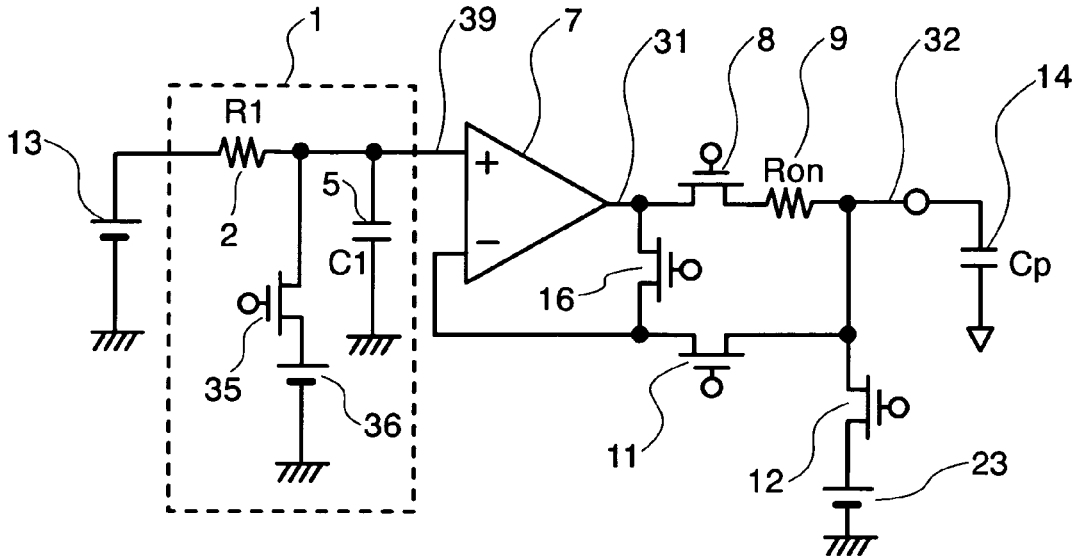
FIG. 5 is a circuit block diagram of embodiment 3 of the invention.
Figure 6:
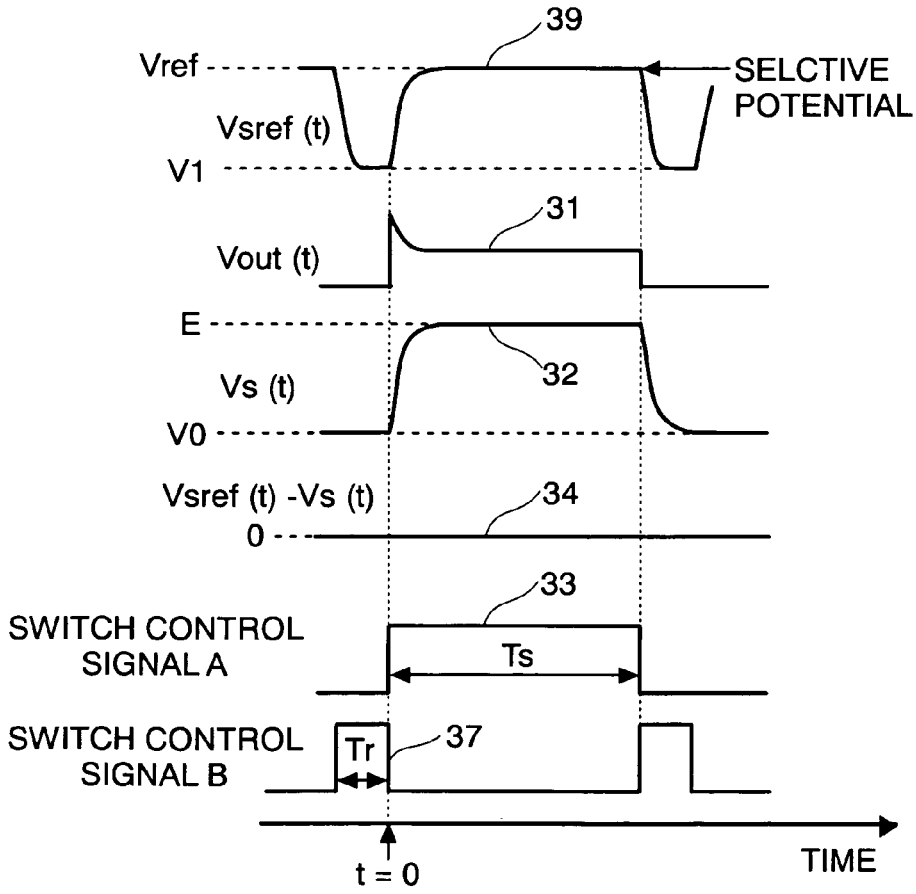
FIG. 6 is an operation waveform diagram for illustrating the embodiment 3.
Figure 7:
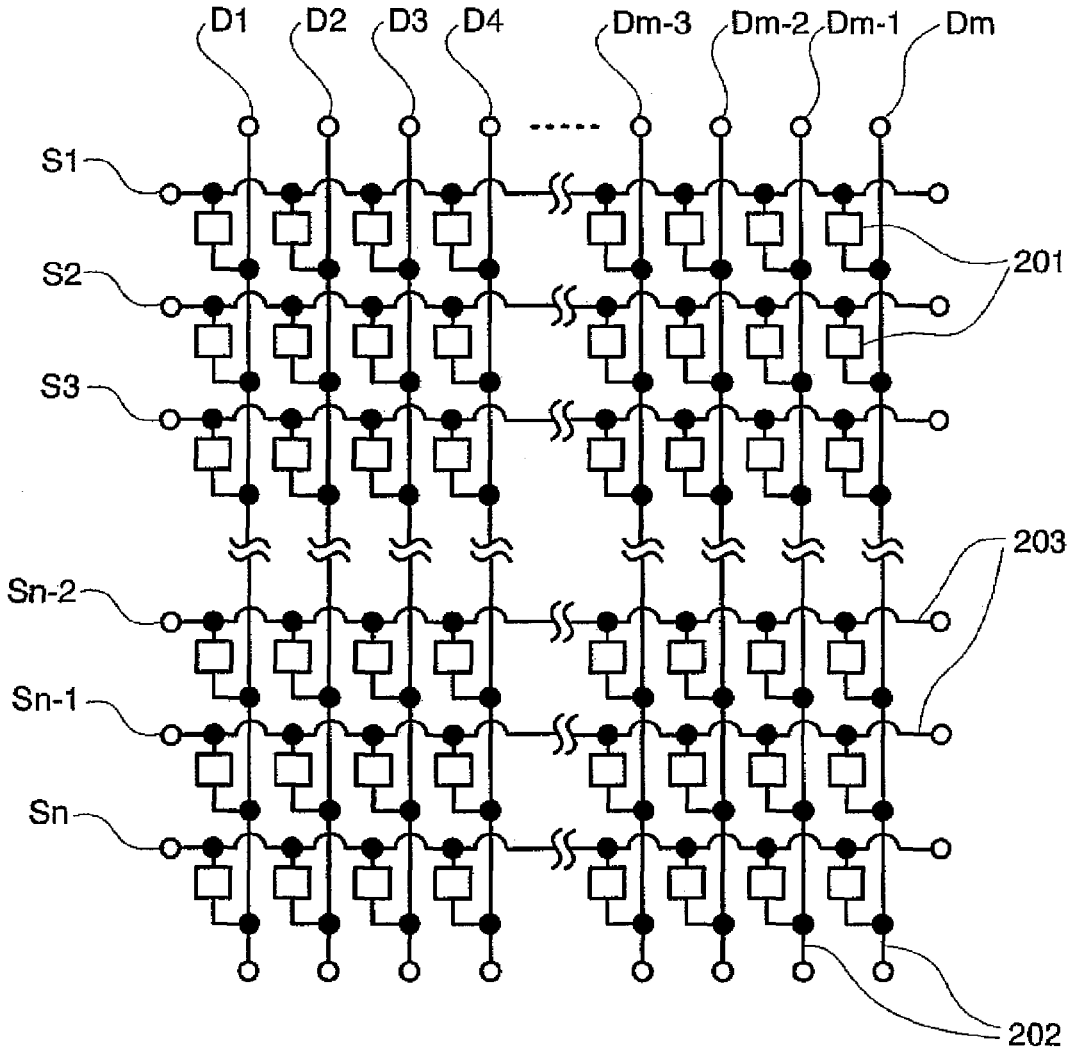
FIG.7 (Prior Art)
FIG. 7 is a structural diagram of a display panel in which electron emitters are disposed in a matrix pattern.

Hereinafter, still another embodiment of an image display device of the invention is described using FIG. 5 and FIG. 6. FIG. 5 is a circuit block diagram of the embodiment, and FIG. 6 is an operation waveform diagram for describing operation in a configuration of FIG. 5.

In FIG. 5, the output terminal of the reference voltage source 13 is connected with the resistance 2 having the resistor value R1, and the capacitor 5 having the capacitance value C1 is connected between one end of the resistor 2 and ground. The switch 35 is connected to the connection point between the resistor 2 and the capacitor 5, and the voltage source 36, and the voltage source 36 is connected to ground.

The switches 35 and 16 are driven by the switch control signal B, which are on in the high level.

The time t<0 corresponds to a non-selection period where the switches 35 and 16 are on, wherein the output voltage of the amplifier 7 is returned into the negative-phase input terminal of the amplifier 7. Therefore, the output voltage of the amplifier 7 during the non-selection period is equal to output voltage of the voltage source 36.

Next, operation during a selection period corresponding to t≧0 is described. In the selection period, the scan selection switch 8 and the feedback switch 11 are turned on by the switch control signal A. Again in this case, respective switches are on in the high level.

Here, the output voltage of the voltage source 36 is substituted by V1, and the reference selection potential signal 39 during the selection period can be expressed by a time function of the following equation (14).

(equation 14)

$$Vsref(t) = Vref \cdot \left(1 - \exp\left(-\frac{1}{R1 \cdot C1} \cdot t\right)\right) + V1 \cdot \exp\left(-\frac{1}{R1 \cdot C1} \cdot t\right) \quad (14)$$

The signal is handled as the differential input signal to the amplifier 7, and the following equation (15) can be obtained from the equation (14) and the equation (10) shown in the embodiment 2.

(equation 15) (15)

$$Vsref(t) - Vs(t) = Vref \cdot \left(1 - \exp\left(-\frac{1}{R1 \cdot C1} \cdot t\right)\right) + V1 \cdot \exp\left(-\frac{1}{R1 \cdot C1} \cdot t\right) - E \cdot (1 - \exp(-bt)) - V0 \cdot \exp(-bt)$$

The following equation (16) is obtained by transforming the equation (15). The equation (16) means that natural logarithm terms can be eliminated by appropriately selecting the voltage V1, resistance value R1, and capacitance value C1.

(equation 16) (16)

$$Vsref(t) - Vs(t) = Vref - (Vref - V1)\exp\left(-\frac{1}{R1 \cdot C1} \cdot t\right) - E \cdot (E - V0)\exp(-bt)$$

According to the equation (16), a circuit condition is given by the following equation (17), thereby the high frequency components in the output voltage can be eliminated. In other words, the overshooting components in the output voltage can be eliminated.

(equation 17) (17)

$$E = Vref$$

$$V0 = V1$$

$$b = \frac{1}{R1 \cdot C1}$$

According to the embodiment, as in the embodiment 1, the scan electrode voltage without overshooting components can be realized for the driving waveform of the scan electrodes of the matrix-type display using the electron emitters as the electron sources, and the excellent image display without pedestal level errors or gray-scale errors can be achieved.

As described hereinbefore, a technique of correcting unevenness in luminance due to limited impedance of a driver circuit is indispensable in the display in which the electron emitters are disposed in the matrix pattern, and excellent image display can be achieved by applying the embodiments of the invention to the matrix-type display.

While the image display device using the thin-film electron sources was given as an example in the embodiments of the invention, it will be appreciated that the embodiments of the invention are effective for image display devices using other cathode elements such as field emission cathode elements, carbon nano-tube cathode elements, and organic EL elements.

What is claimed is:

1. A display device, comprising, a scan-electrode drive circuit for driving scan electrodes connected to a plurality of electron emitters disposed in a matrix pattern, wherein the scan-electrode drive circuit includes, a selection circuit for selecting the scan electrode, a detection circuit for detecting electric potential of the selected scan electrode, a correction circuit having one input into which the detected electric potential of the scan electrode is inputted, and a generation circuit that inputs a reference selection potential signal into another input of the correction circuit, wherein the generation circuit delays inputted reference voltage and outputs the reference selection potential signal, and wherein the generation circuit includes, a first voltage source for determining the reference voltage, a first resistance connected to output of the first voltage source, capacitance connected to one end of the first resistance, and a second resistance and a switch, which are connected in series to a connection point between the first resistance and the capacitance.

2. The display device according to claim 1, wherein the generation circuit delays the reference voltage by using resistance and capacitance and outputs the voltage as the reference selection potential signal.

3. A display device, comprising, a scan-electrode drive circuit for driving scan electrodes connected to a plurality of electron emitters disposed in a matrix pattern, wherein the scan-electrode drive circuit includes, a selection circuit for selecting the scan electrode, a detection circuit for detecting electric potential of the selected scan electrode, a correction circuit having one input into which the detected electric potential of the scan electrode is inputted, and a generation circuit that inputs a reference selection potential signal into another input of the correction circuit, wherein the generation circuit delays inputted reference voltage and outputs the reference selection potential signal, and wherein the generation circuit includes, a first voltage source for determining the reference voltage, a first resistance connected to output of the first voltage source, capacitance connected to one end of the first resistance, and a switch and a second voltage source, which are connected in series to a connection point between the first resistance and the capacitance.

4. A display device, comprising, a display panel having a plurality of scan lines and a plurality of data lines that intersect with the scan lines, a plurality of electron emitters connected to both the lines, and phosphors that are allowed to emit light by electrons from the electron emitters, a scan-electrode drive circuit connected to respective scan electrodes of the scan lines, a data-electrode drive circuit connected to respective data electrodes of the data lines, and a high-voltage circuit for converging the electrons from the electron emitters and irradiating the electrons to the phosphors, wherein the scan-electrode drive circuit includes, a selection circuit for selectin each of the scan electrodes, a detection circuit for detecting electric potential of each of the scan electrodes, a correction circuit that establishes predetermined electric potential for each of the scan electrodes based on scan electrode potential detected by the detection circuit, and a generation circuit connected to an input side of the correction circuit, wherein the correction circuit includes an amplifier, wherein the generation circuit generates a reference selection potential signal in consideration of phase lag elements including capacitance of the display panel and the selection circuit, and wherein the generation circuit includes, a first voltage source for determining a DC level of the reference selection potential signal, a first impedance element connected to output of the first voltage source, a capacitance element connected to one end of the first impedance element, and a second impedance element and a switch, which are connected in series to a connection point between the first impedance element and the capacitance element.

5. The display device according to claim 4, wherein the correction circuit includes a reference signal input terminal into which a reference selection potential signal for determining electric potential of each of scan electrodes, and wherein the generation circuit outputs the reference selection potential signal for gradually changing from non-selection potential to selection potential to the reference signal input terminal at the beginning of a selection period of horizontal scan.

6. A display device, comprising, a display panel having a plurality of scan lines and a plurality of data lines that intersect with the scan lines, a plurality of electron emitters connected to both the lines, and phosphors that are allowed to emit light by electrons from the electron emitters, a scan-electrode drive circuit connected to respective scan electrodes of the scan lines, a data-electrode drive circuit connected to respective data electrodes of the data lines, and a high-voltage circuit for converging the electrons from the electron emitters and irradiating the electrons to the phosphors, wherein the scan-electrode drive circuit includes, a selection circuit for selecting each of the scan electrodes, a detection circuit for detecting electric potential of each of the scan electrodes, a correction circuit that establishes predetermined electric potential for each of the scan electrodes based on scan electrode potential detected by the detection circuit, and a generation circuit connected to an input side of the correction circuit, wherein the correction circuit includes an amplifier, wherein the generation circuit generates a reference selection potential signal in consideration of phase lag elements including capacitance of the display panel and the selection circuit, and wherein the generation circuit includes, a first voltage source for determining a DC level of the reference selection potential signal, a first impedance element connected to output of the first voltage source, a capacitance element connected to one end of the first impedance element, and a switch and a second voltage source, which are connected in series to a connection point between the first impedance element and the capacitance element.

7. A method for driving a display panel including a display panel having a plurality of scan lines and a plurality of data lines that intersect with the scan lines, a plurality of electron emitters connected to both the lines, and phosphors that are allowed to emit light by electrons from the electron emitters, a scan-electrode drive circuit connected to respective scan electrodes of the scan lines, a data-electrode drive circuit connected to respective data electrodes of the data lines, and a high-voltage circuit for converging the electrons from the electron emitters and irradiating the electrons to the phosphors, wherein the scan-electrode drive circuit includes a selection circuit for selecting each of the scan electrodes, a detection circuit for detecting electric potential of each of the scan electrodes, a correction circuit that establishes predetermined electric potential for each of the scan electrodes based on scan electrode potential detected by the detection circuit, and a generation circuit connected to an input side of the correction circuit, wherein the correction circuit includes an amplifier, and the generation circuit generates a reference selection potential signal in consideration of phase lag elements including capacitance of the display panel and the selection circuit, and wherein the generation circuit includes a first voltage source for determining a DC level of the reference selection potential signal a first impedance element connected to output of the first voltage source, a capacitance element connected to one end of the first impedance element, and a second impedance element and a switch, which are connected in series, to a connection point between the first impedance element and the capacitance element; the method comprising steps of, selecting a scan electrode by the selection circuit, detecting the electric potential of the selected scan electrode by the detection circuit, and supplying the reference selection potential signal having a delayed reference voltage from the generation circuit, such that the scan electrode is set to be in a predetermined electric potential by the correction circuit into which the detected electric potential of the scan electrode is inputted, to another input of the correction circuit.

* * * * *